US006413318B2

(12) United States Patent
Yoo et al.

(10) Patent No.: US 6,413,318 B2
(45) Date of Patent: Jul. 2, 2002

(54) SHEET COATING APPARATUS

(75) Inventors: Yong-baek Yoo, Suwon; Kyung-yol Yon, Seongnam, both of (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 51 days.

(21) Appl. No.: 09/725,943

(22) Filed: Nov. 30, 2000

(30) Foreign Application Priority Data

Feb. 25, 2000 (KR) ..... 00-9388

(51) Int. Cl.[7] ..... B05C 1/08

(52) U.S. Cl. ..... 118/620; 118/621; 118/249; 118/262; 118/DIG. 1; 101/424.2; 399/342

(58) Field of Search ..... 118/46, 620, 621, 118/249, 261, 262, DIG. 1; 101/424.2; 399/341, 342; 156/277–280; 427/458, 428

(56) References Cited

U.S. PATENT DOCUMENTS 4,869,921 A * 9/1989 Gabel et al. ..... 101/424.2
5,797,326 A * 8/1998 Buschulte et al. ..... 101/416.1
6,187,094 B1 * 2/2001 Mitsuhata et al. ..... 118/101

* cited by examiner

*Primary Examiner*—Laura Edwards
(74) *Attorney, Agent, or Firm*—Sughrue Mion, PLLC

(57) ABSTRACT

A sheet coating apparatus including a storage tank in which a coating liquid having charged coating particles dispersed therein is contained, a development roller rotatably installed to be immersed in the coating liquid, a voltage source for applying a voltage to the development roller, a coating roller rotatably installed in a state in which it is partially immersed in the coating liquid while maintaining a predetermined development gap relative to the development roller, and a compression roller for pressing a sheet passing between the compression roller and the coating roller toward the coating roller while securely rotating with respect to the coating roller. The coating particles adhere to the surface of the coating roller at the development gap due to an electric force to then be coated on the sheet passing between the coating roller and the compression roller. The sheet coating apparatus can prevent excess coating liquid from being coated on a sheet by regulating the amount of the coating liquid coated on the sheet, thereby attaining uniform coating.

4 Claims, 1 Drawing Sheet

SHEET COATING APPARATUS

BACKGROUND OF THE INVENTION

1. Field of the Invention

The present invention relates to a sheet coating apparatus for applying a predetermined coating liquid onto a sheet.

2. Description of the Related Art

In a liquid electrophotographic printer, e.g., a laser printer, in order to prevent a printed image from blotting on paper and to improve the resolution of an image, a coating apparatus for applying a coating liquid such as wax after a printing operation has been proposed. A conventional coating apparatus, as shown in FIG. 1, is configured such that a coating roller 10 and a backup roller 20 are rotatably installed along the traveling path through which a sheet 1 passes, and the coating roller 10 is partially immersed in a storage tank 30 containing a liquid wax W. Accordingly, the wax W sticking to the coating roller 10 is coated onto the printed surface of the sheet 1 passing between the coating roller 10 and the backup roller 20.

However, in the above-described coating system, since there is no means of regulating the amount of wax W moving upward along the surface of the coating roller 10 according to rotation thereof and which is to be coated onto the sheet 1 by the coating roller 10, it is not possible to regulate the amount of coated wax. Thus, the amount of coated wax is nonuniform and excess wax is likely to be coated, which results in increased consumption of a coating liquid. If the content of the coating liquid is reduced, that is, if the content of a liquid carrier which is a solvent contained in the coating liquid, is increased, the amount of the coating liquid consumed can be reduced. However, since the liquid carrier heavily contained in the coating liquid is considerably absorbed into the sheet 1, the image printed on the sheet 1 is likely to blot. In order to overcome the problem of carrier absorption, if the content of the wax is increased, the consumption of the coating liquid increases. Also, since the viscosity of the coating liquid is increased, the flow of the coating liquid is not smooth, and thus the coating thickness becomes nonuniform. Therefore, a coating apparatus which can allow uniform coating while reducing the consumption of a coating liquid, is required.

SUMMARY OF THE INVENTION

To solve the above problems, it is an object of the present invention to provide an improved sheet coating apparatus which can uniformly regulate the amount of a coating liquid coated onto a sheet.

Accordingly, to achieve the above object, there is provided a sheet coating apparatus including a storage tank in which a coating liquid having charged coating particles dispersed therein is contained, a development roller rotatably installed to be immersed in the coating liquid, a voltage source for applying a voltage to the development roller, a coating roller rotatably installed in a state in which it is partially immersed in the coating liquid while maintaining a predetermined development gap relative to the development roller, and a compression roller for pressing a sheet passing between the compression roller and the coating roller toward the coating roller while securely rotating with respect to the coating roller, wherein the coating particles adhere to the surface of the coating roller at the development gap due to an electric force to then be coated on the sheet passing between the coating roller and the compression roller.

BRIEF DESCRIPTION OF THE DRAWINGS

The above object and advantages of the present invention will become more apparent by describing in detail a preferred embodiment thereof with reference to the attached drawings, in which.

DETAILED DESCRIPTION OF THE PREFERRED EMBODIMENTS

The coating apparatus described in the present invention can be used for coating general sheet-type materials, but the following embodiments relate to the case of a coating liquid being coated on a sheet having an image printed thereon in a printer.

In a sheet coating apparatus according to the present invention, wax organosol having charged coating particles is used as a coating liquid. The coating liquid is a mixture of a powdered wax, a liquid carrier and a charge control agent, and the wax particles are charged by the charge control agent. The polarity of the wax particles may be either positive or negative. In the present embodiment, the wax particles are positively charged.

Figure 1:
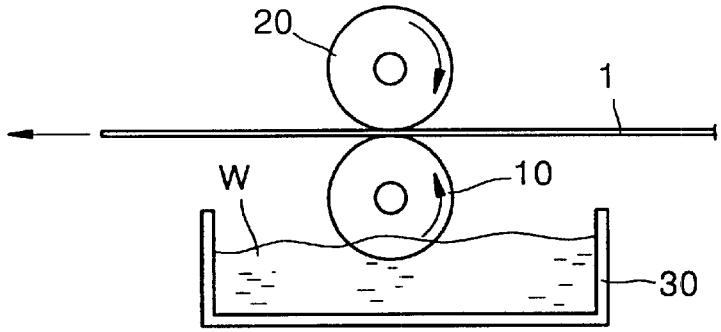
FIG. 1 (PRIOR ART)
FIG. 1 is a schematic diagram illustrating a conventional sheet coating apparatus.
Figure 2:
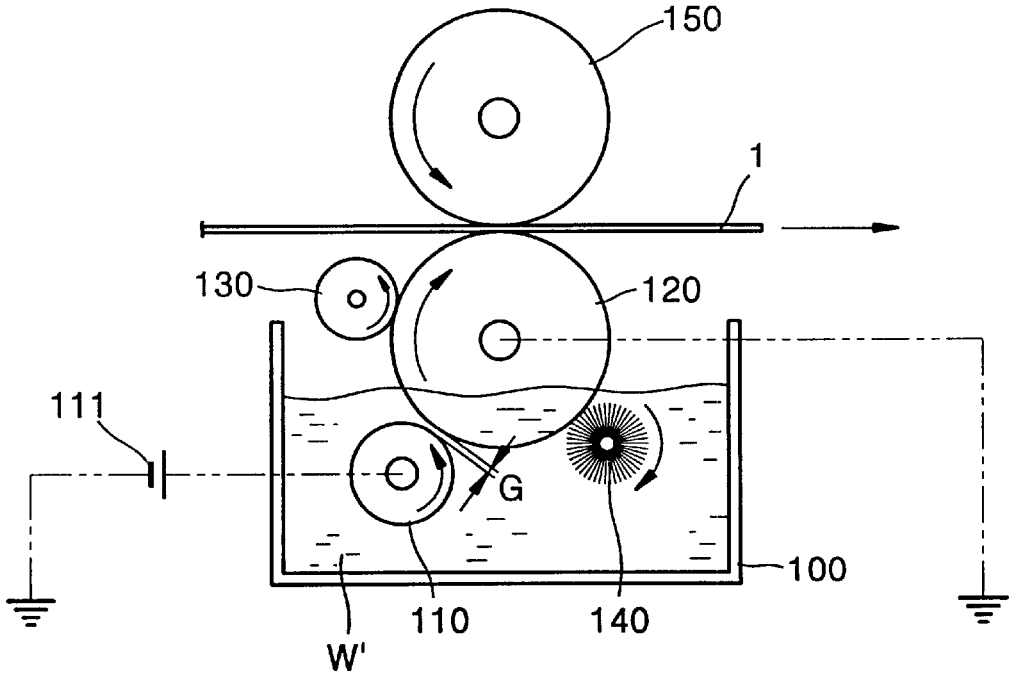
FIG. 2 is a schematic diagram illustrating a sheet coating apparatus according to the present invention.

The coating liquid W' is accommodated in a storage tank 100, as shown in FIG. 2. A development roller 110 rotating in a state in which it is immersed in the coating liquid W' is provided in the storage tank 100. A high voltage of approximately 200 to 600 V is applied from a voltage source 111 to the development roller 110. This is called a development bias voltage. Also, a coating roller 120 rotating while maintaining a development gap G of 50 to 200 $\mu$m relative to the development roller 110, is installed in the storage tank 100. The lower side of the coating roller 120 is immersed in the coating liquid W' and is kept at the development gap G relative to the development roller 110. The upper side of the coating roller 120 is securely pressed against a compression roller 150. The coating roller 120 is grounded to 0 volts. Thus, a development operation in which the charged wax particles contained in the coating liquid W' adhere to the surface of the coating roller 120, is carried out at the development gap G by a voltage difference between the development roller 110 and the coating roller 120. Reference numeral 130 denotes a squeegee roller securely pressed against the coating roller 120 and which rotates. The squeegee roller 130 compresses the wax particles developed on the coating roller 120 to make the same into a film and squeegees the liquid carrier contained in the film. Reference numeral 140 denotes a brush roller for forming a uniform development film during development by removing wax particles adhering to the surface of the coating roller 120 before an area of the surface of the coating roller 120 reaches the development gap G.

In the apparatus having the aforementioned configuration, a sheet 1 to be coated passes between the coating roller 120 and the compression roller 150. In this case, a development bias voltage is applied from the voltage source 111 to the development roller 110. Accordingly, development is carried out at the development gap G by an electric force so that the wax particles are developed on the surface of the coating roller 120. The developed wax particles are compressed by the squeegee roller 130 to then be made into a film and then coated on one surface of the sheet 1 passing between the coating roller 120 and the compression roller 150 by greater tendency of the wax to adhere to the sheet 1 rather than to the coating roller 120. Thereafter, any wax particles remaining on the coating roller 120 are removed by the brush roller 140 and then the procedure following development is repeated for coating a subsequent sheet.

According to the above-described coating operation, wax particles are uniformly distributed by an induced electric force rather than adhering to the surface of the coating roller 120, to then be coated on the sheet 1. Thus, a uniform coating film can be formed with less coating liquid being consumed than in the conventional case. Also, the amount of wax coated on the sheet can be controlled by varying a development bias voltage.

As described above, the sheet coating apparatus according to the present invention can prevent excess coating liquid from being coated on a sheet and can prevent the coating liquid from being absorbed into the sheet by liquid carrier, by controlling the amount of the coating liquid coated on a sheet, thereby attaining uniform coating.

It is contemplated that numerous modifications may be made to the sheet coating apparatus of the present invention without departing from the spirit and scope of the invention as defined in the following claims.

What is claimed is:

1. A sheet coating apparatus comprising:

a storage tank in which a coating liquid having charged coating particles dispersed therein is contained;

a development roller rotatably installed to be immersed in the coating liquid;

a voltage source for applying a voltage to the development roller;

a coating roller rotatably installed in a state in which the coating roller is partially immersed in the coating liquid while maintaining a predetermined development gap relative to the development roller; and a compression roller for pressing a sheet passing between the compression roller and the coating roller toward the coating roller while securely rotating with respect to the coating roller, wherein the coating particles adhere to a surface of the coating roller at the development gap due to an electric force to then be coated on the sheet passing between the coating roller and the compression roller.

2. The sheet coating apparatus according to claim 1, further comprising a squeegee roller rotating in secure contact with the coating roller for compressing the coating particles coated on the coating roller before being coated on the sheet to make the coating particles into a film, and for squeegeeing a carrier contained in the film.

3. The sheet coating apparatus according to claim 1, further comprising a brush roller rotating in contact with the surface of the coating roller for removing coating particles remaining on the surface of the coating roller after coating the sheet.

4. The sheet coating apparatus according to claim 1, wherein the coating liquid comprises wax organosol including a powdered wax, a liquid carrier which is a solvent and a charge control agent for charging the coating particles.

* * * * *